US006853120B2

(12) United States Patent
Ninomiya

(10) Patent No.: US 6,853,120 B2
(45) Date of Patent: Feb. 8, 2005

(54) CATHODE-RAY TUBE WITH SHADOW MASK VIBRATION SUPPRESSOR

(75) Inventor: Shiro Ninomiya, Toyonaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/283,428

(22) Filed: Oct. 29, 2002

(65) Prior Publication Data

US 2003/0080665 A1 May 1, 2003

(30) Foreign Application Priority Data

Oct. 30, 2001 (JP) ..... 2001-332562

(51) Int. Cl.[7] ..... H01J 29/80
(52) U.S. Cl. ..... 313/402; 313/407
(58) Field of Search ..... 313/269, 402–408

(56) References Cited

U.S. PATENT DOCUMENTS 6,520,475 B2 * 2/2003 Haun et al. ..... 313/402
6,621,200 B2 9/2003 Reed

FOREIGN PATENT DOCUMENTS

| | | |
|---|---|---|
| EP | 0 984 482 | 3/2000 |
| EP | 1 089 311 | 4/2001 |
| JP | 2000-77007 | 3/2000 |
| KR | 2002-0066979 | 8/2002 |

* cited by examiner

*Primary Examiner*—Joseph Williams
(74) *Attorney, Agent, or Firm*—Merchant & Gould P.C.

(57) ABSTRACT

Positions of paired perforations that are provided in a shadow mask and through which a vibration suppressor is to be inserted with play are deviated from each other in a horizontal direction and in a vertical direction. Since the positions of the paired perforations are deviated from each other not only in the vertical direction but also in the horizontal direction, upon vibrations of the shadow mask, the vibration suppressor surely comes into contact with, rubs against, and separates from the periphery of both of the paired perforations. Consequently, a vibration attenuating effect by the vibration suppressor is exhibited stably, and a vibration decay time can be reduced.

5 Claims, 9 Drawing Sheets

CATHODE-RAY TUBE WITH SHADOW MASK VIBRATION SUPPRESSOR

BACKGROUND OF THE INVENTION

1. Field of the Invention

The present invention relates to a color cathode-ray tube, particularly to a color cathode-ray tube including a shadow mask that is stretched with a tension applied thereto in one direction.

2. Related Background Art

In a color cathode-ray tube, an electron beam emitted from an electron gun irradiates a phosphor screen formed on an inside surface of a face panel, so that a desired image is displayed. A shadow mask that functions as a color selecting electrode is provided on an electron gun side of the phosphor screen, with a predetermined distance therebetween. The shadow mask is made of a metal plate, in which a multiplicity of electron-beam-passing apertures, each having a rectangular shape (slot shape), are arrayed to allow an electron beam to pass therethrough and impinge on a phosphor at a desired position. Such a shadow mask is held in a state of being stretched.

A deviation of positions of the electron-beam-passing apertures of the shadow mask relative to positions of the phosphors on the phosphor screen causes the electron beams to irradiate a phosphor different from a desired one (this phenomenon is called "mislanding"), thereby causing image quality deterioration, which is called color shift.

One of causes of the mislanding is a phenomenon of thermal expansion of a shadow mask when heated by an electron beam, that is, the so-called doming. To prevent this, the shadow mask is stretched with a tension applied thereto in one direction, so that the thermal expansion is absorbed.

However, the shadow mask stretched with a tension applied thereto tends to vibrate when vibrations or impacts such as vibrations from speakers are transmitted from outside to the shadow mask, and to incur degraded attenuation of the vibrations. Therefore, a display screen tends to sway or become blurred.

One method for attenuating the vibration of the shadow mask is disclosed in JP2000-77007A. The method is described below, with reference to FIG. 7.

FIG. 7 is a schematic perspective view of a mask structure composed of a shadow mask 120 and a frame 130 for framing the shadow mask 120 while stretching the same.

The frame 130 is formed by bonding two pairs of rod-type members into a rectangular frame shape. The shadow mask 120 is made of a flat plate material in an approximately rectangular shape, in which a multiplicity of electron-beam-passing apertures 122 through which an electron beam is to pass are arrayed regularly in an X axis direction and a Y axis direction. The shadow mask 120 is held in a state of being welded to one side of each of supporting members 131*a* and 131*b* that form long sides of the frame 130, with a tension T in a direction of a shorter side of the frame 130 being applied to the shadow mask 120.

A plurality of pairs of perforations 125 are formed in end regions of the shadow mask 120, the end regions being at ends of the shadow mask 120 in a direction perpendicular to a direction in which the tension T is applied, in a manner such that each pair of the perforations 125 is arranged in the direction in which the tension T is applied. A vibration suppressor 140 formed by bending a wire-rod into a rectangular frame form is inserted through each pair of the perforations 125 with play.

Such a mask frame is housed in a color cathode-ray tube, arranged so that the direction of the tension T coincides with a vertical direction.

When the shadow mask 120 vibrates, the vibration suppressor 140 moves independently from the shadow mask 120, while coming into contact with, rubbing against, and separating from the periphery of the perforations 125 in the shadow mask. The vibration energy of the shadow mask 120 is consumed by friction caused by such a movement of the vibration suppressor 140 relative to the perforations 125 of the shadow mask 120. Thus, the vibration suppressor 140 functions as a vibration attenuator for attenuating the vibration of the shadow mask 120.

However, the foregoing conventional vibration attenuating method has a problem in that in the case where the same vibrations (or impacts) are applied to a shadow mask, a vibration decay time is not stabilized, and this increases the mean decay time.

The causes of this problem were analyzed in detail, and the following phenomenon was confirmed.

FIG. 8A is an enlarged front view of a portion where the vibration suppressor 140 as a vibration attenuator is attached, and FIG. 8B is a cross-sectional view of the portion taken along an arrow line 8B—8B shown in FIG. 8A, viewed in a direction indicated by the arrows. As shown in the drawing, the vibration suppressor 140 bent in the approximate rectangular frame form is provided with play through a pair of the perforations 125*a* and 125*b*, which are formed apart in the vertical direction of the shadow mask 120. The vibration suppressor 140 is attached in a manner such that both ends of the wire-rod bent into an angular U shape are inserted into the pair of perforations 125*a* and 125*b*, and then, the both ends are bent back. Here, in some cases, errors occur at bent positions of the vibration suppressor 140. For instance, as shown in FIGS. 8A and 8B, the vibration suppressor 140 sometimes is attached in a manner such that most of a weight of the vibration suppressor 140 is borne by only a surrounding of the lower perforation 125*b*. In this case, an upper end of the vibration suppressor 140 is stabilized in an inclined state, the inclination being in either one of directions indicated by arrows 142 within a plane parallel with a surface of the shadow mask 120, as shown in FIG. 8A, and in either one of directions indicated by arrows 143 within a plane perpendicular to the surface of the shadow mask 120, as shown in FIG. 8B. When the shadow mask 120 vibrates in this state, the vibration suppressor 140 also floatingly moves in the directions indicated by the arrows 142 and 143. Therefore, the upper bent portion 140*a* of the vibration suppressor 140 sometimes comes into contact with or rubs against the surrounding of the upper perforation 125*a*, and sometimes does not. When the upper bent portion 140*a* of the vibration suppressor 140 is in contact with or rubs against the surrounding of the upper perforation 125*a*, the effect of attenuating the vibration of the shadow mask 120 is increased. Otherwise, it is decreased. Consequently, the vibration decay time varies, and as a whole, the mean decay time increases.

In contrast to the foregoing, the vibration suppressor 140 is attached in a state of being hung from the upper perforation 125*a* in some cases, as shown in FIGS. 9A and 9B. When the shadow mask 120 vibrates in this state, a lower end of the vibration suppressor 140 floatingly moves in a direction indicated by an arrow 144 within a plane parallel with a surface of the shadow mask 120 as shown in FIG. 9A, and in a direction indicated by an arrow 145 within a plane perpendicular to the surface of the shadow mask 120 as shown in FIG. 9B. In this case as well, therefore, the lower bent portion 140*b* of the vibration suppressor 140 sometimes comes into contact with or rubs against the surrounding of the lower perforation 125*b*, and sometimes does not. Consequently, the vibration decay time varies, and as a whole, the mean decay time increases.

As described above, with the conventional vibration attenuating method employing the vibration suppressor 140, it is difficult to achieve a desired vibration attenuating effect stably due to a relative dimension error between bent positions of the vibration suppressor (or a distance between the upper bent portion 140*a* and the lower bent portion 140*b*) and positions of a pair of perforations at which the vibration suppressor 140 is attached.

SUMMARY OF THE INVENTION

Therefore, with the foregoing in mind, it is an object of the present invention to provide a color cathode-ray tube that, with a vibration attenuating method employing a vibration suppressor being applied thereto, solves the foregoing problem of the prior art to stabilize a vibration attenuating effect with a simple mechanism and reduce the vibration decay time.

To achieve the foregoing object, the present invention has a configuration as follows.

A color cathode-ray tube of the present invention includes a shadow mask that is held in a state of being stretched with a tension applied in one direction, and a vibration suppressor attached to the shadow mask in a manner such that the vibration suppressor is floatingly movable. In the color cathode-ray tube device, the vibration suppressor is attached in a state of being inserted with play through a pair of perforations provided in the shadow mask, and, positions of the paired perforations are deviated from each other in a horizontal direction and in a vertical direction.

DETAILED DESCRIPTION OF THE INVENTION

Figure 1:
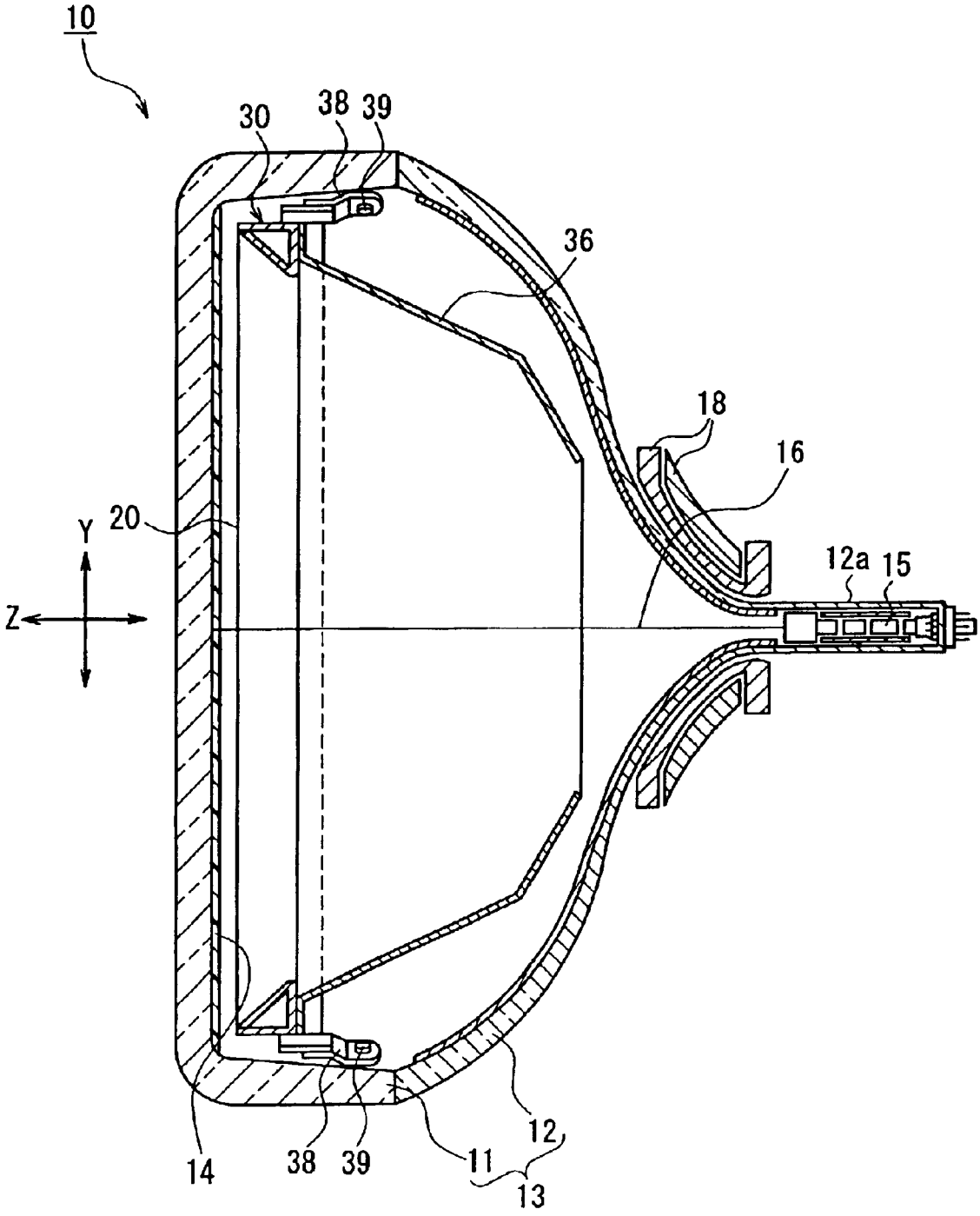
FIG. 1 is a cross-sectional view of a color cathode-ray tube according to an embodiment of the present invention, which is taken along a plane extending in a vertical direction and including a tube axis of the color cathode-ray tube.

In the color cathode-ray tube of the present invention, since the positions of the paired perforations are deviated from each other not only in the vertical direction but also in the horizontal direction, upon vibrations of the shadow mask, the vibration suppressor surely will come into contact with, rub against, and separate from surroundings of both of the paired perforations. Consequently, a vibration attenuating effect by the vibration suppressor is exhibited stably, and a vibration decay time can be reduced.

In the foregoing configuration, the perforations preferably are provided in an outer region in the horizontal direction relative to the region in which electron-beam-passing apertures are formed in the shadow mask. This makes it possible to avoid collision of an electron beam with the vibration suppressor and deterioration of images resulting therefrom.

In this case, among the paired perforations, the perforation on an upper side preferably is formed at a position farther from the region in which electron-beam-passing apertures are formed, as compared with a position of the perforation on a lower side.

Furthermore, the positions of the paired perforations in the horizontal direction preferably are determined so that the vibration suppressor, in a stabilized state, is inclined due to the gravity toward a side farther from the region in which electron-beam-passing apertures are formed.

With the foregoing configurations, it is possible to reduce further the possibility of image deterioration caused by the collision of an electron beam with the vibration suppressor.

The following will describe the present invention in detail while referring to the drawings.

FIG. 1 is a vertical cross-sectional view of a color cathode-ray tube 10 of the present invention, taken along a plane that includes a tube axis and extends in a vertical direction. For convenience in the following description, in a state in which the color cathode-ray tube 10 is placed so that the tube axis is parallel with the horizontal direction, an XYZ three-dimensional rectangular coordinate system is assumed, in which a horizontal axis perpendicular to the tube axis is assumed to be the X axis, a vertical axis perpendicular to the tube axis is assumed to be the Y axis, and the tube axis is assumed to be the Z axis, as shown in the drawings. Here, the X axis and the Y axis cross each other on the tube axis (the Z axis).

A housing 13 is formed by integrally providing a face panel 11 and funnel 12. On an inside surface of the face panel 11, a phosphor screen 14 is formed in an approximately rectangular shape. A shadow mask 20 serving as a color selecting electrode is provided in a state of being stretched on a frame 30 in an approximately rectangular frame shape, being spaced from the phosphor screen 14 and facing the same. On a side of the frame 30 opposite to the shadow mask 20, an inner magnetic shield 36 is provided integrally with the same. The inner magnetic shield 36 is formed by bonding two pairs of metal plates, each in an approximately trapezoidal shape, which are arranged to face each other so as to form a part of surfaces of an approximate quadrangular pyramid. Elastic supporters 38, each in a plate spring form, are provided at four corners of the frame 30, which frames the shadow mask 20 while stretching the same and is integrated with the inner magnetic shield 36. The elastic supporters 38 are hooked on panel pins 39 that are fixed on the inside surface of the face panel 11, so that the frame 30 is supported on the face panel 11. An electron gun 15 is housed in a neck portion 12*a* of the funnel 12.

A deflection yoke 18 is provided on a circumferential surface of the funnel 12 of the color cathode-ray tube 10 thus configured, so that an electron beam 16 from the electron gun 15 is deflected by the deflection yoke 18 in the horizontal direction or the vertical direction to scan the phosphor screen 14.

Figure 2:
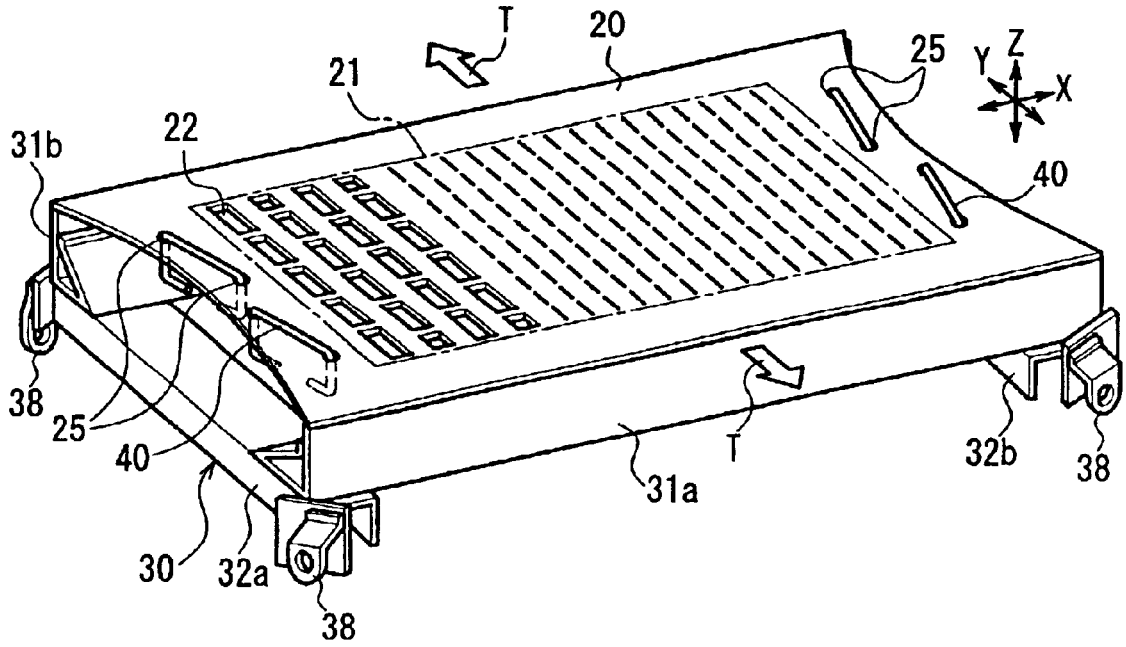
FIG. 2 is a perspective view schematically illustrating a configuration of a mask structure composed of a shadow mask of the color cathode-ray tube according to the embodiment of the present invention and a frame for framing the shadow mask while stretching the same.

FIG. 2 is a perspective view illustrating a schematic configuration of a mask structure composed of the shadow mask 20 and the frame 30 that frames the shadow mask 20 while stretching the same.

As shown in the drawing, the frame 30 is composed of a pair of supporting members 31*a* and 31*b*, each having a cross section in an approximate triangular shape, and a pair of connecting members 32*a* and 32*b*, each having a cross-section in an approximate angular "U" shape, which are shorter in length than the supporting members 31*a* and 31*b*. The pair of supporting members 31*a* and 31*b* are spaced apart from each other and parallel with each other and so are the pair of connecting members 32*a* and 32*b*. Ends of the foregoing members are welded with each other, so that the frame 30 in an approximate rectangular frame shape is formed.

The shadow mask 20 is made of a flat plate material in an approximate rectangular shape, having a multiplicity of perforations 22, each in a slot form, through which an electron beam is to pass (electron-beam-passing apertures), arrayed regularly in the X axis direction and in the Y axis direction (FIG. 2 shows only a part of the electron-beam-passing apertures). Alternate long and short dashed lines 21 indicate a region where the electron-beam-passing apertures are formed. The electron-beam-passing apertures 22 can be formed by a known method, for instance, etching. The shadow mask 20 thus configured is held with a tension T in the Y axis direction (direction parallel with a lengthwise direction of the connecting members 32*a* and 32*b*) being applied to one side of each of the supporting members 31*a* and 31*b*, which constitute the longer sides of the frame 30.

A plurality of pairs of perforations 25 are formed in outer regions on both sides in the X axis direction outside the electron-beam-passing aperture region 21 in the shadow mask 20. A vibration suppressor 40 as a vibration attenuator formed by bending a metal wire-rod into a rectangular frame form is attached to each pair of the perforations 125.

Figure 3A:
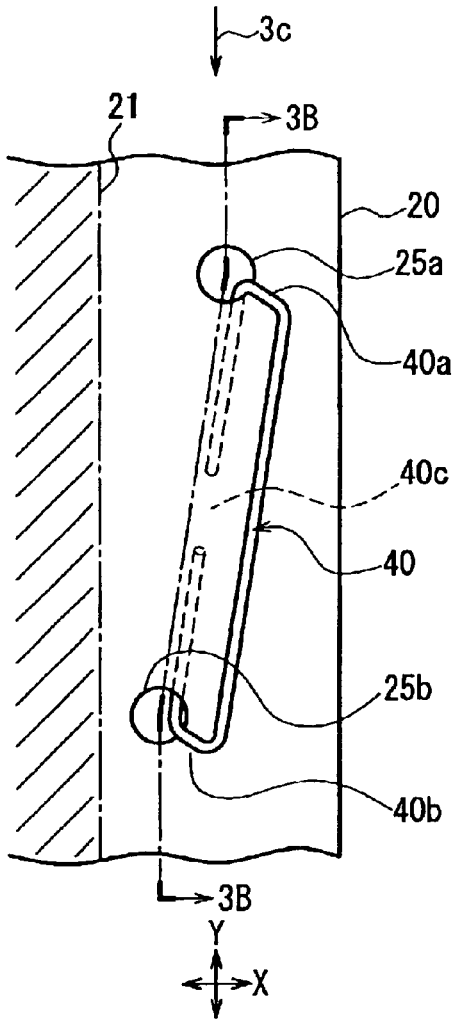
FIG. 3A is an enlarged front view illustrating a portion of the color cathode-ray tube according to the embodiment of the present invention, in which a vibration suppressor is attached.
Figure 3B:
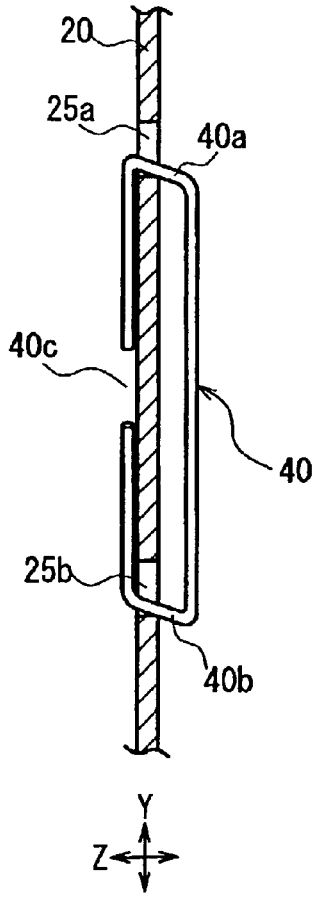
FIG. 3B is a combined cross-sectional view of the portion taken along an alternate long and short dashed line 3B—3B shown in FIG. 3A, viewed in a direction indicated by the arrows.
Figure 3C:
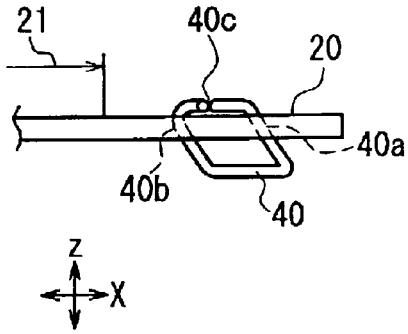
FIG. 3C is a top view of the vibration suppressor, viewed in a direction indicated by an arrow 3C shown in FIG. 3A.

Details of a portion at which the vibration suppressor 40 is attached are shown in FIGS. 3A to 3C. FIG. 3A is an enlarged front view of the portion where the vibration suppressor 40 is attached. FIG. 3B is a combined cross-sectional view of the portion taken along an alternate long and short dashed line 3B—3B shown in FIG. 3A, viewed in a direction indicated by the arrows. FIG. 3C is a top view of the vibration suppressor, viewed in a direction indicated by an arrow 3C shown in FIG. 3A. As is clear from FIG. 3A, in the present embodiment, positions of the paired perforations 25*a* and 25*b* to which the vibration suppressor 40 is attached are deviated from each other in the X axis direction (horizontal direction), unlike the conventional perforations 125*a* and 125*b* for attachment shown in FIG. 7. More specifically, the upper perforation 25*a* is arranged at a position farther from the electron-beam-passing aperture region 21 in the X axis direction, as compared with a position of the lower perforation 25*b*.

Figure 7:
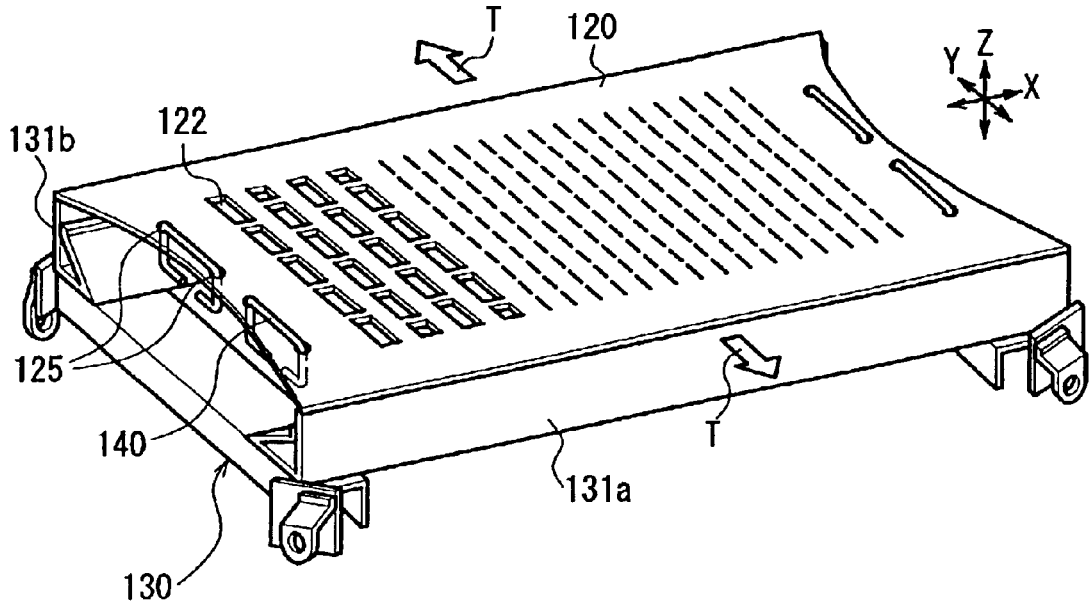
FIG. 7 PRIOR ART
FIG. 7 is a perspective view schematically illustrating a mask structure composed of a shadow mask of a conventional color cathode-ray tube and a frame for framing the shadow mask while stretching the same.
Figure 8A:
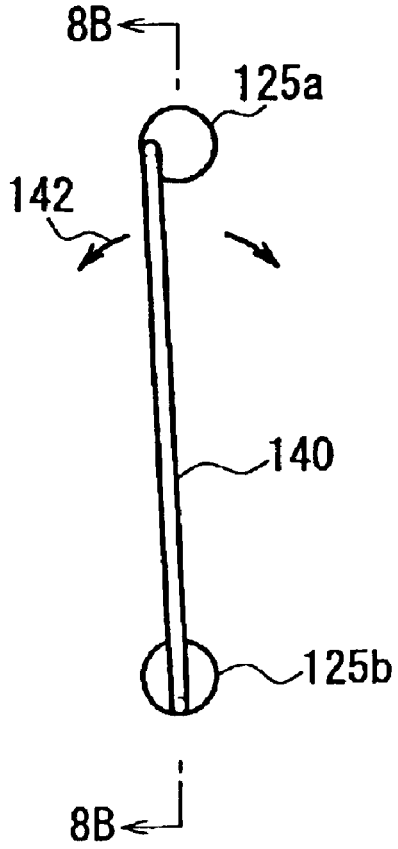
FIG. 8A PRIOR ART
FIG. 8A is an enlarged front view illustrating a portion of the conventional color cathode-ray tube, in which a vibration suppressor is attached.
Figure 8B:
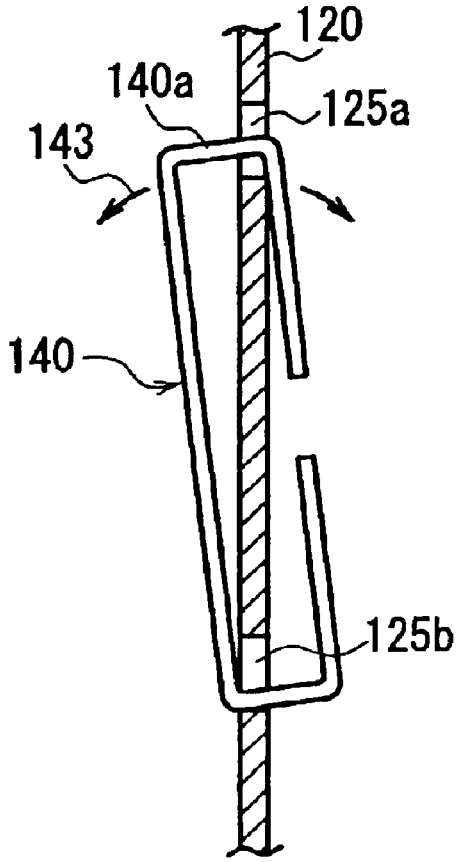
FIG. 8B PRIOR ART
FIG. 8B is a cross-sectional view of the portion taken along a line 8B—8B shown in FIG. 8A, viewed in a direction indicated by the arrows.
Figure 9A:
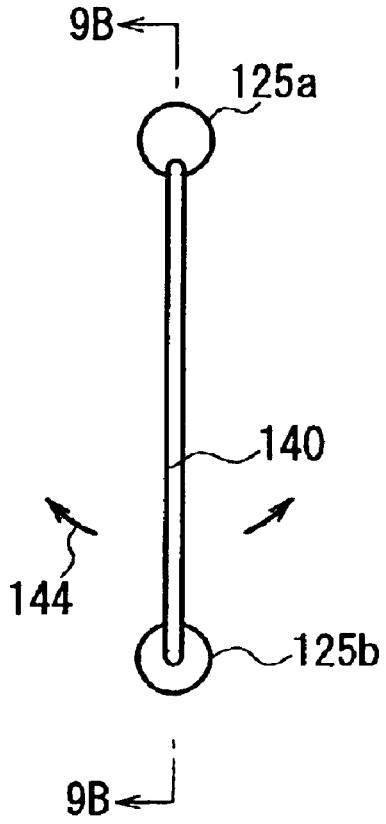
FIG. 9A PRIOR ART
FIG. 9A is an enlarged front view illustrating another example of a portion of the conventional color cathode-ray tube, in which a vibration suppressor is attached.
Figure 9B:
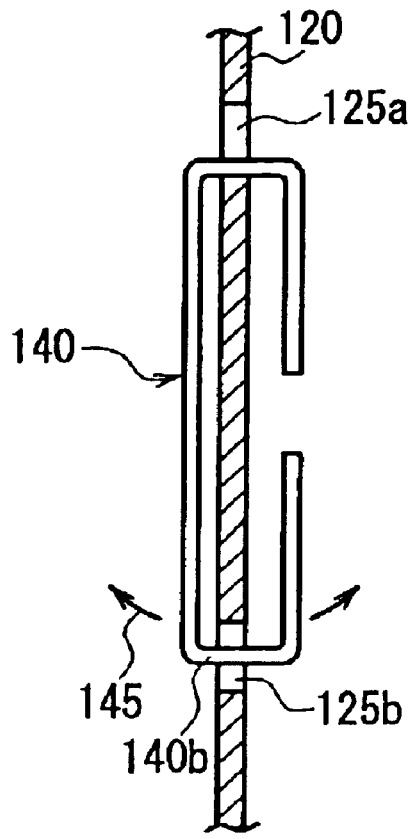
FIG. 9B PRIOR ART
FIG. 9B is a cross-sectional view of the portion taken along a line 9B—9B shown in FIG. 9A, viewed in a direction indicated by the arrows.

The vibration suppressor 40 has the same configuration as that of the conventional vibration suppressor 140 shown in FIG. 7.

Since an aperture diameter of each of the perforations 25*a* and 25*b* is set to be slightly greater than an element wire diameter of the vibration suppressor 40, the vibration suppressor 40 is not fixed to the shadow mask 20. Therefore, the vibration suppressor 40 is allowed to move (move floatingly) independently from the shadow mask 20 in a state of being attached to the shadow mask 20.

The vibration attenuating effect of the vibration suppressor 40 of the present invention is described below.

By forming the upper perforation 25*a* not immediately above the lower perforation 25*b* but obliquely above the same (i.e., forming the upper and lower perforations 25*a* and 25*b* so that their positions are deviated from each other in the X axis direction (horizontal direction)), the vibration suppressor 40 inserted through the perforations 25*a* and 25*b* with play is stabilized in a state of being inclined permanently with respect to the Y axis direction (vertical direction), as shown in FIG. 3A. In this state, the vibration suppressor 40 maintains a state in which the upper bent portion 40*a* and the lower bent portion 40*b* thereof always are in contact with a periphery of the upper perforation 25*a* and a periphery of the lower perforation 25*b*, respectively.

In this state, when the shadow mask 20 vibrates, the upper bent portion 40*a* and the lower bent portion 40*b* of the vibrator 40 repetitively come into contact with, rub against, and separate from the surrounding of the upper perforation 25*a* and the surrounding of the lower perforation 25*b*, respectively. Friction thus occurring at the both portions consumes vibration energy of the shadow mask 20 quickly. Thus, the vibration of the shadow mask 20 is attenuated rapidly.

As described above, in the present invention, positions of the paired perforations 25*a* and 25*b* to which the vibration suppressor 40 functioning as a vibration attenuator is attached are deviated from each other not only in the vertical direction but also in the horizontal direction. This allows the vibration suppressor 40 to conduct, upon vibration of the shadow mask 20, the contact, rubbing, and separation with respect to both of the perforations always and without fail. Consequently, the vibration attenuating effect by the vibration suppressor 40 is exhibited stably, while the vibration decay time can be reduced. Furthermore, with the configuration in which the positions of the paired perforations 25*a* and 25*b* are deviated from each other in the horizontal and vertical directions, relative dimensional tolerances are increased regarding the bent positions of the vibration suppressor 40 (a distance between the upper bent portion 40*a* and the lower bent portion 40*b*) and the positions of the paired perforations 25*a* and 25*b* through which the vibration suppressor 40 is inserted with play.

Furthermore, by deviating the positions of the paired perforations 25*a* and 25*b* in the horizontal direction (the X axis direction) from each other, the upper and lower bent portions 40*a* and 40*b* of the vibration suppressor 40 attached are, in a stabilized state, not perpendicular to the surface of the shadow mask 20 but inclined (rotated) to either one of the directions due to the effect of gravity, as shown in FIGS. 3A to 3B. In the vibration suppressor 40 shown in FIGS. 3A to 3C, a portion thereof behind the shadow mask 20 in FIG. 3A is lighter in weight than a portion thereof before the shadow mask 20 in the drawing, since a discontinued portion 40*c* is present in the former. Therefore, assuming that points at which the upper and lower bent portions 40*a* and 40*b* of the vibration suppressor 40 are in contact with the surroundings of the perforations 25*a* and 25*b* are fulcra, a moment of the latter having no discontinued portion 40*c* due to the gravity becomes greater. Therefore, as shown in the drawings, the vibration suppressor 40 is stabilized in an inclined state in which the portion before the shadow mask 20, having no discontinued portion 40*c*, is on a lower side. In the present invention, in the case where the vibration suppressor 40 is stabilized in the inclined state due to the gravity, positions of the paired perforations 25*a* and 25*b* in the horizontal direction (X axis direction) preferably are set so that the inclination provides a decreasing proximity of the vibration suppressor 40 to the electron-beam-passing aperture region 21. This prevents the vibration suppressor 40 from entering the electron-beam-passing aperture region 21, thereby preventing collision of the electron beam with the vibration suppressor 40 and deterioration of images resulting therefrom. Therefore, in the present embodiment, the upper perforation 25*a* is arranged at a position farther from the electron-beam-passing aperture region 21, as compared with a position of the lower perforation 25*b*. Furthermore, as shown in FIG. 2, the perforations 25 in both the regions outside the electron-beam-passing aperture region 21 in the X axis direction are symmetrical with respect to the Y axis.

The following will describe an example in which the present invention was applied to a mask structure for use in a 34-inch diagonal color cathode-ray tube.

Figure 4:
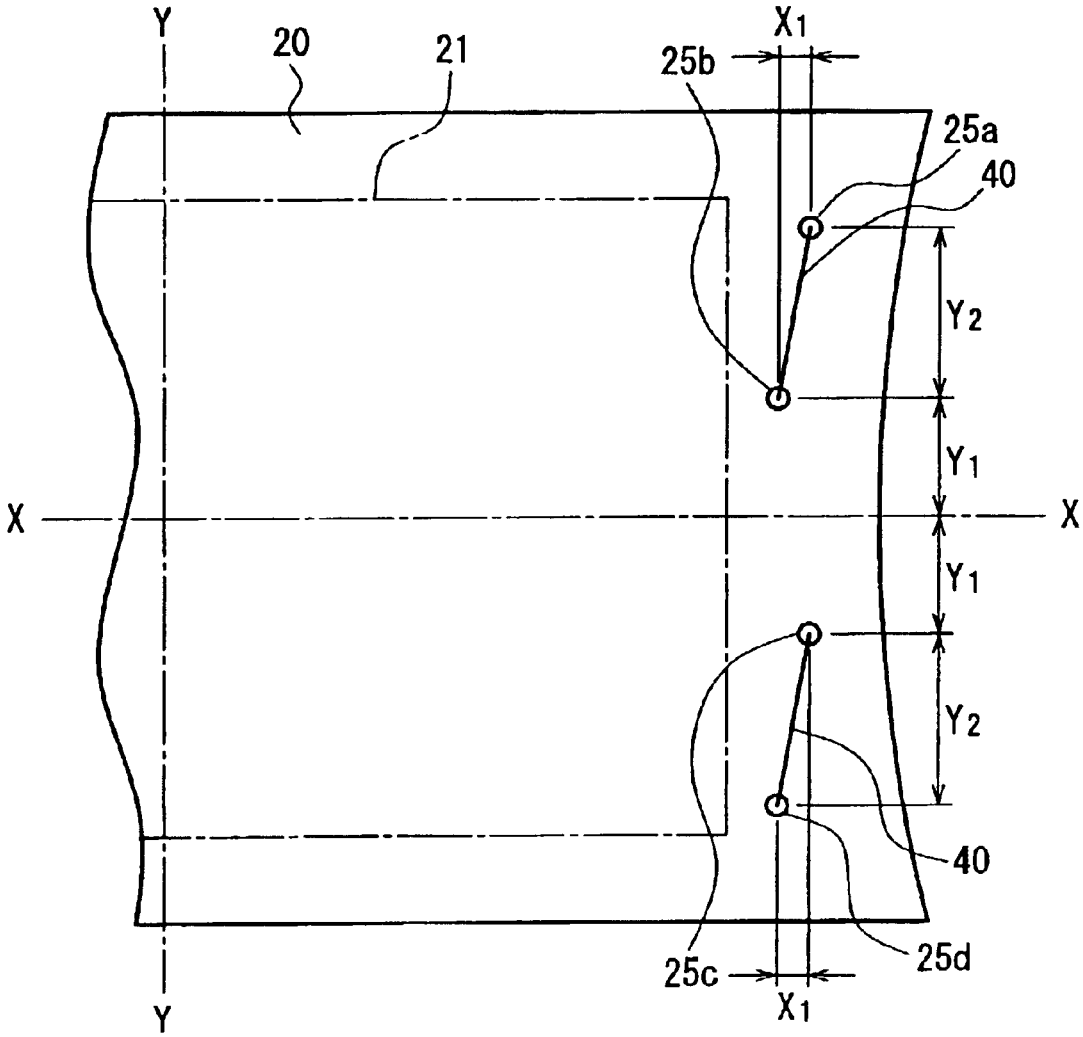
FIG. 4 is a front view illustrating in detail a portion in which vibration suppressors are attached, in the color cathode-ray tube according to the embodiment of the present invention.

As shown in FIG. 2, a mask structure obtained by framing a shadow mask 20 made of a metal plate material with a thickness of 0.13 mm, while stretching the same with a tension of 100 N in total load in the Y axis direction being applied thereto. In each of outer regions outside an electron-beam-passing aperture region 21 in the X axis direction in the shadow mask 20, two pairs of vibration suppressors 40 were attached. The details are shown in FIG. 4. In FIG. 4, perforations 25*a*, 25*b*, 25*c*, and 25*d* for attaching the vibration suppressors 40 had an approximately round shape with an inside diameter of 1.4 mm. A distance Y1 to the X axis from the center of the perforation closer to the X axis in each pair, i.e., the perforation 25*b* or 25*c*, was set to be 40 mm. A distance Y2 in the Y axis direction between the centers of the perforations of each pair, i.e., 25*b* and 25*a*, or 25*c* and 25*d*, was set to be 120 mm. A distance X1 in the X axis direction between the centers of the perforations 25*b* and 25*a*, or between the centers of the perforations 25*c* and 25*d*, was set to be 2.1 mm. FIG. 4 shows only a right part of the shadow mask 20, but in a left part thereof also, two pairs of perforations were formed so as to be symmetrical with respect to the Y axis, and the vibration suppressor 40 was attached to each pair.

Figure 5:
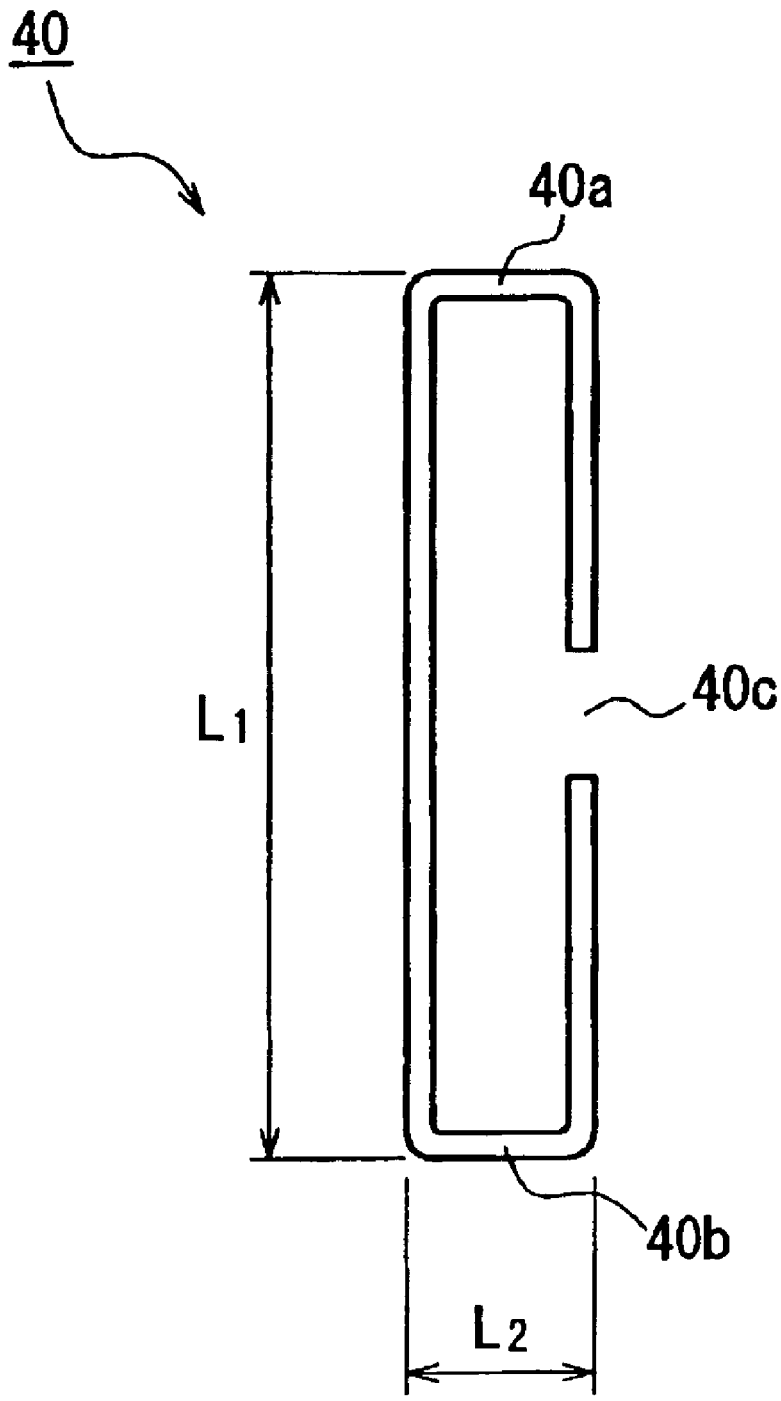
FIG. 5 is a front view schematically illustrating a shape of a vibration suppressor used in an example of the present invention.

The vibration suppressor 40 was formed using a metal wire material having a total length of 145 mm, an element wire diameter of 0.9 mm, and a mass of 0.74 g. The metal wire material was bent into an angular U shape, and was attached to the shadow mask 20 by inserting the same into a pair of the perforations in the shadow mask 20, and bending ends of the same back as shown in FIG. 5. In FIG. 5, a length L1 of a central straight portion was set to be 80 mm, and a length L2 of each of bent portions 40*a* and 40*b* continued to ends of the straight portion was set to be 2.0 mm. In FIG. 5, 40*c* denotes a discontinued portion between the ends of the wire material thus bent.

The mask structure thus configured was held so that the top thereof as viewed in FIG. 4 came on the top. An impulse-like impact was applied to the shadow mask 20, and a time necessary for a vibration amplitude of the shadow mask 20 to decay to half (decay time) was measured. This was repeated a plurality of times.

As a comparative example, the same vibration suppressors 40 were attached in the same manner as those in the foregoing present example in FIG. 4 except for Y2=120 mm and X1=0 mm, and the decay time was measured in the same manner.

Figure 6:
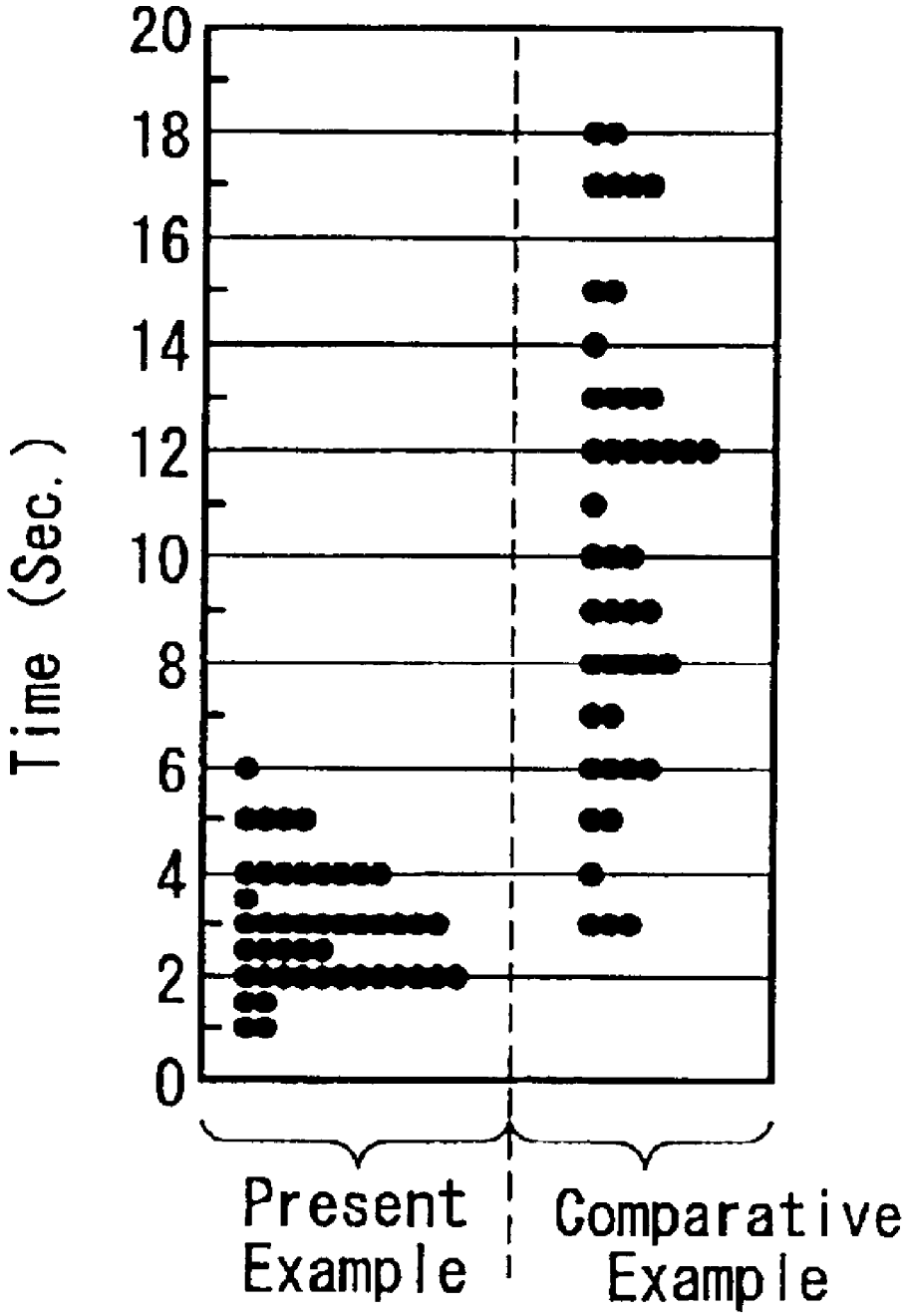
FIG. 6 is a view showing measured vibration decay times of shadow masks in the present example and a comparative example.

The results are shown in FIG. 6. In FIG. 6, the vertical axis represents the decay time (second), and solid circles (●) indicate individual values of measured decay times.

As is clear from FIG. 6, a mean value of the decay times was approximately 3 seconds in the present example, while it was approximately 10 seconds in the comparative example. This shows that the mean decay time was reduced in the present invention. Further, a variance of the decay time (difference between the maximum value and the minimum value) was 5 seconds in the present example, while it was 15 seconds in the comparative example. Thus, the variance of the present example was one third of that of the comparative example. As described above, in the present invention, a vibration suppressor stably comes into contact with, rubs against, and separates from surroundings of two perforations through which the vibration suppressor is inserted with play, without failure. Therefore, this allows the vibration attenuating effect of the vibration suppressor to be exhibited surely, thereby decreasing the vibration decay time of the shadow mask, as well as the variance of the same.

The present invention is not limited to the foregoing embodiment and example.

For instance, as a vibration suppressor, one formed by bending a rod-wire into a rectangular frame shape is shown, but the shape of the same is not limited to the foregoing; any shape is applicable as long as it allows the vibration suppressor to freely move independently from the vibration of the shadow mask 20 and to be held on the shadow mask 20 without falling therefrom. For instance, the vibration suppressor may be formed in any one of circular shapes, elliptic shapes, and varieties of polygonal shapes. Furthermore, it may include a discontinued portion (for instance, the discontinued portion 40*c* shown in FIGS. 3A to 3C and FIG. 5) while maintaining a shape approximate to any one of the foregoing as a whole. Alternatively, the discontinued portion may be welded or the like after the attachment to the shadow mask so as to be continuous.

Furthermore, the size and the weight of the vibration suppressor are not limited to those of the present example described above, and they may be selected appropriately according to the magnitude of the tension applied to the shadow mask and the thickness thereof.

Furthermore, the number of the vibration suppressors is not limited to four as in the present example described above, but it may be determined appropriately according to the size of the color cathode-ray tube, the magnitude of the tension applied to the shadow mask, the thickness thereof, the weight of the vibration suppressor, etc.

Furthermore, the vibration suppressor is not limited to that made of a rod-wire as described above, but it may be formed using a plate-like material with a narrow width.

Furthermore, FIGS. 3A to 3C show an example in which the vibration suppressor 40 is inclined (rotated) in a manner such that a portion of the vibration suppressor 40 on the phosphor screen side with respect to the shadow mask 20 is separated from the electron-beam-passing aperture region 21 due to a moment generated by the gravity, but the present invention is not limited to this example. For instance, depending on the positions at which the surroundings of the perforations 25*a* and 25*b* are brought into contact with the upper bent portion 40*a* and the lower end portion 40*b* of the vibration suppressor 40, a moment generated by the gravity and applied to the portion of the vibration suppressor 40 on the electron gun side with respect to the shadow mask 20 (the portion having the discontinued portion 40*c*) is greater than that applied to the other portion. Alternatively, in the case where the bending back of the rod-wire of the vibration suppressor 40 on the electron gun side with respect to the shadow mask 20 is insufficient (i.e., one or both angles formed between the end portions of the rod-wire bent back and the upper and lower bent portions 40*a* and 40*b* are not right angles but obtuse angles), a moment generated by gravity and applied to the portion of the vibration suppressor 40 on the electron gun side with respect to the shadow mask 20 (the portion having the discontinued portion 40*c*) is greater than that applied to the other portion. In such a case, the vibration suppressor 40 is inclined in a manner such that the portion of the vibration suppressor 40 on the electron gun side with respect to the shadow mask 20, to which the greater moment is generated, is separated from the electron-beam-passing aperture region 21. More specifically, as described above, by setting the horizontal direction distance from the electron-beam-passing aperture region 21 to the upper perforation 25*a* to be greater than the horizontal direction distance therefrom to the lower perforation 25*b*, the vibration suppressor 40 can be inclined in a manner such that a portion of the vibration suppressor 40 in which a greater moment is generated by the gravity, on either the phosphor screen side or the electron gun side with respect to the shadow mask 20, is separated from the electron-beam-passing aperture region 21. In many cases, the "portion in which a greater moment is generated" is the portion that protrudes more from a surface of the shadow mask 20 than the other portion does. Therefore, the vibration suppressor 40 is inclined (rotated) so that the portion of the vibration suppressor 40 that protrudes more from a front or back surface of the shadow mask 20 is separated from the electron-beam-passing aperture region 21. Therefore, it is possible to prevent the collision of the electron beam with the vibration suppressor 40 and deterioration of images resulting therefrom. It should be noted that such an effect is achieved also even in the case where the vibration suppressor has a shape other than the rectangular frame shape as in the above-described embodiment.

Furthermore, an aperture shape of each perforation for attaching a vibration suppressor is not necessarily a circular shape as in the above-described embodiment. It may be any one of elliptic shapes, slit shapes, and varieties of polygonal shapes. Particularly in the case where each aperture has either an elliptic shape or a slit shape and its major axis direction is directed in the vertical direction or in a direction of a line passing the centers of paired perforations to which a vibration suppressor is attached, a dimension tolerance range for the vibration suppressor and the perforations is increased. Consequently, a more stable vibration suppressing effect is achieved, and the production cost is reduced.

Furthermore, in the example of FIG. 4, regarding the perforations 25*a* and 25*b* for attaching a vibration suppressor, which are paired and formed above the X axis, and the perforations 25*c* and 25*d* for attaching a vibration suppressor, which are paired and formed below the X axis, the upper perforations 25*a* and 25*c* are formed at positions farther from the electron-beam-passing aperture region 21 as compared with the positions of the lower perforations 25*b* and 25*d*. However, the present invention is not limited to the foregoing configuration. More specifically, it is possible to form the upper perforations at positions closer to the electron-beam-passing aperture region 21 as compared with the positions of the lower perforations. Even in such a case, the same vibration attenuating effect as that of the above-described example can be achieved. For instance, in the case where the shadow mask 20 has sides in the X axis direction that are curved so that the width of the shadow mask 20 in the X axis direction is decreased at the center in the Y axis direction as shown in FIG. 4, exclusively for the perforations 25*c* and 25*d* formed below the X axis, the upper perforation 25*c* may be formed at a position closer to the electron-beam-passing aperture region 21 as compared with the position of the lower perforation 25*d*. This makes it possible to decrease the width in the X axis direction of a region in which the vibration suppressors 40 are attached (an outer region in the X axis direction outside the electron-beam-passing aperture region 21).

Furthermore, in the present embodiment described above, a case in which the vibration suppressors are attached outside the electron-beam-passing aperture region of the shadow mask 20 is taken as an example, but the vibration suppressors may be attached inside the electron-beam-passing aperture region. In this case, it is necessary to attach the vibration suppressors in portions other than the electron-beam-passing apertures, so that displayed images of the color cathode-ray tube are not affected.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color cathode-ray tube comprising:

a shadow mask that is held in a state of being stretched with a tension applied in one direction; and a vibration suppressor attached to the shadow mask in a manner such that the vibration suppressor is floatingly movable, wherein the vibration suppressor passes with play through and extends between a pair of perforations provided in the shadow mask, and positions of the paired perforations are deviated from each other in a horizontal direction and in a vertical direction.

2. The color cathode-ray tube according to claim 1, wherein the perforations are provided in an outer region in the horizontal direction relative to a region in which electron-beam-passing apertures are formed in the shadow mask.

3. The color cathode-ray tube according to claim 2, wherein among the paired perforations, the perforation on an upper side is formed at a position farther from the region in which electron-beam-passing apertures are formed, as compared with a position of the perforation on a lower side.

4. The color-cathode-ray tube according to claim 2, wherein the positions of the paired perforations in the horizontal direction are determined so that the vibration suppressor, in a stabilized state, is inclined due to the gravity toward a side farther from the region in which electron-beam-passing apertures are formed.

5. A color cathode-ray tube comprising:

a shadow mask that is held in a state of being stretched with a tension applied in one direction; and a vibration suppressor attached to the shadow mask in a manner such that the vibration suppressor is floatingly movable, wherein the vibration suppressor includes a one piece structure that passes with play through a pair of perforations provided in the shadow mask, and positions of the paired perforations are deviated from each other in a horizontal direction and in a vertical direction.

* * * * *